United States Patent [19]

Lazenby, III

[11] Patent Number: 4,756,479

[45] Date of Patent: Jul. 12, 1988

[54] FLUSH HYDRANT

[76] Inventor: George I. Lazenby, III, 119 Rue Max St., Pensacola, Fla. 32507

[21] Appl. No.: 36,977

[22] Filed: Apr. 6, 1987

[51] Int. Cl.[4] ..... B05B 15/02

[52] U.S. Cl. ..... 239/110; 137/302; 137/625.22; 239/200; 239/581.1

[58] Field of Search ..... 239/104, 106, 110, 200, 239/581.1; 137/302, 596, 625.22, 625.24

[56] References Cited

U.S. PATENT DOCUMENTS

| | | | |
|---|---|---|---|
| 334,315 | 1/1886 | Walsh, Jr. | 137/625.22 |
| 935,857 | 10/1909 | Palmer | 137/302 |
| 959,092 | 5/1910 | Wileman | 137/625.22 |
| 2,905,196 | 9/1959 | Van Wagenen et al. | 239/110 |
| 3,023,768 | 3/1962 | Niemi | 137/302 |
| 3,229,720 | 1/1966 | Hirschowitz | 137/625.22 |
| 3,464,449 | 9/1969 | Morton | 137/625.24 |
| 4,099,543 | 7/1978 | Mong et al. | 137/625.22 |
| 4,125,128 | 11/1978 | Elward et al. | 137/625.22 |
| 4,548,237 | 10/1985 | Bogenschutz | 137/625.22 |

FOREIGN PATENT DOCUMENTS

| | | | |
|---|---|---|---|
| 14424 | 7/1888 | Fed. Rep. of Germany | 137/625.24 |

*Primary Examiner*—Andres Kashnikow
*Assistant Examiner*—Michael J. Forman
*Attorney, Agent, or Firm*—C. A. Phillips

[57] ABSTRACT

A flush hydrant for purging waterline systems of subdivisions, rural districts, etc. The flush hydrant is used in lieu of a typical fire hydrant for purging such waterlines of foreign matter which may have infiltrated the waterline system as a result of line breakage. The flush hydrant includes a barrel generally having an upper portion extending above ground and a lower portion below ground. The hydrant includes a ball valve assembly mounted in the lower portion of the barrel and an operating rod extending above ground from the valve assembly. The rod operates a closure member in the ball valve between open and closed positions. The closure member is provided with a primary passageway to direct water into the barrel and out of a nozzle secured thereto, and, with secondary passageways to drain water from the barrel to the outside of the assembly after the valve has been closed by the closure member.

3 Claims, 3 Drawing Sheets

FLUSH HYDRANT

TECHNICAL FIELD

This invention relates generally to fire hydrants and specifically to a flush hydrant for use in purging water lines of a water system which has become contaminated.

BACKGROUND OF THE INVENTION

Fire hydrants generally are provided at spaced intervals throughout water line systems of areas having fire protection, such as cities, subdivisions, rural districts, etc. Generally, many of the systems of water lines are subject to becoming infiltrated with foreign matter as a result of water line breakage from such causes as being broken by heavy equipment during construction, or, in rural areas, by a tractor, etc. In such cases, generally before service can be restored, the system must be purged of foreign matter. Generally, this is accomplished by locating the fire hydrant at the end of the water line system and opening the hydrant for flowing water through until the foreign matter, such as mud, etc., is purged from the water lines.

The use of fire hydrants for purging such systems is an expensive undertaking. First of all, typical fire hydrants are expensive. Secondly, the use of such expensive hydrants requires wear and tear on the working parts of the hydrant in a purging operation when the use of the hydrant should be restricted to its intended purpose, i.e., for fighting fires.

Typically, fire hydrants (such as the American-Darling valve, a division of American Cast Iron Company) include a barrel having a nozzle at its upper end and a base at its lower end. A globe valve is mounted in a seat carried in the base. The valve includes a valve top, bottom, and a special hydrant valve rubber of conical shape. A valve rod is screwed into the valve base and extends upwardly and through the top cover of the hydrant assembly. A hydrant seat is threadably secured in the barrel assembly and includes drain channels for draining water from the barrel after the hydrant has been used and the valve closed. A spring biased drain lever is provided with washers thereon to seal the drain channels during use of the hydrant.

Each time such fire hydrants are used, the globe valve in the hydrant is turned many times against the valve seat in frictional engagement therewith. Such frictional engagement, of course, causes substantial wear and tear on the parts. The drain lever washers also receive unneeded wear by coming into engagement with the surfaces around the drain channels.

One way of reducing the wear and tear of the hydrant operating parts is to eliminate the use of fire hydrants for such secondary functions as purging water lines of foreign matter, or, in sme cases, stagnant water, etc. This may be accomplished by providing separate, inexpensive flush hydrants at strategic locations of a water line system, such as at the end of a water line system of a subdivision.

Such flush hydrants must be dependable and inexpensive. To this end, applicant has provided a flush hydrant having a ball valve assembly therein which uses a ball closure member to perform the dual function of controlling flow through the valve body and draining the water from the barrel of the hydrant assembly after flow through the valve body has been stopped. This is accomplished in applicant's structure without the need of the three-piece globe valve, the expensive hydrant seat with its drain ports therein, and the drain lever and washers carried by the drain lever for closing the drain channel. Also, the need of a spring for biasing the drain lever downwardly for engagement of the washers with the drain ports is eliminated.

SUMMARY OF THE INVENTION

A flush hydrant including a barrel provided with an upper end having a nozzle secured thereto and a lower end connected to a source of water pressure. A valve assembly is provided at the bottom of the barrel in communication with the water source and the interior of the barrel for passage of water thereto from the source of water and for draining water from the barrel after the flush hydrant is used. The valve assembly includes an annular closure member rotatably operable in the valve body between open and closed positions. The closure member is provided with primary and secondary water passageways. In its open position, the secondary passageways are blocked, and water flows through the primary passageway into the barrel and out of the nozzle. With the closure member in its closed position, the primary passageway is blocked to prevent water from flowing therethrough, and water is drained out of the barrel through the secondary water passageways, which are now open to the barrel and open to the outside of the valve body.

DESCRIPTION OF THE PREFERRED EMBODIMENT

Figure 1:
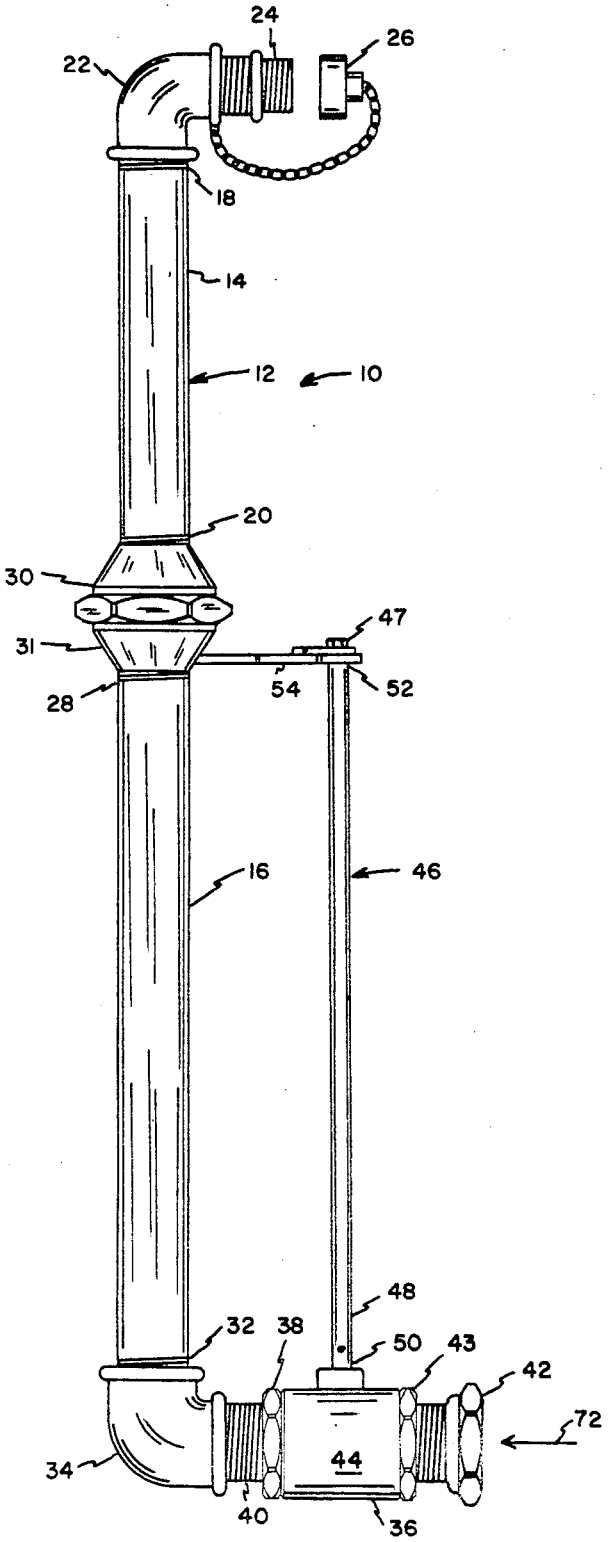
FIG. 1 is an elevational view of the flush hydrant of the present invention.

As seen in FIG. 1, a flush hydrant 10 includes a housing or barrel 12 having upper and lower sections 14 and 16. Upper section 14 includes upper and lower threaded ends 18 and 20. An elbow 22 is secured to upper end 18, and a nozzle 24 is threadably secured to elbow 22. A cap 26 is provided to be threadably secured to nozzle 24. The lower end 20 of section 14 is secured to the upper threaded end 28 of lower section 16 by a union 30. The lower end 32 of lower section 16 is threadably secured to an elbow 34, and a ball valve assembly 36 has one end 38 secured to the elbow 34 by a threaded nipple 40. A compression shoe 42 is secured to the other end 43 of the body 44 of ball valve assembly 36. FIG. 1 further illustrates a rod 46 having one end 48 secured to a stem 50 of ball valve assembly 36. A second end 52 of rod 46 is supported in a support member 54 in the shape of a flat bar which is secured to the lower section 31 of union 30. Rod 46 is provided for controlling the opening and closing of the ball valve assembly in a manner to be described below. Rod 46 is provided with a hex bolt 47 (FIG. 2) at the upper end thereof. A flat bar 49 (approximately 5/16"×1" flat stock) is secured to the bolt (as by welding, etc.) and is provided with an opening 51 for communicating with an opening 53 of member 54 to receive a padlock. When openings 51 and 53 are in alignment, the ball valve has been rotated to a closed position, and the padlock may be emplaced to secure flat bar 49 to member 54 in the position shown in FIG. 2.

Figure 3:
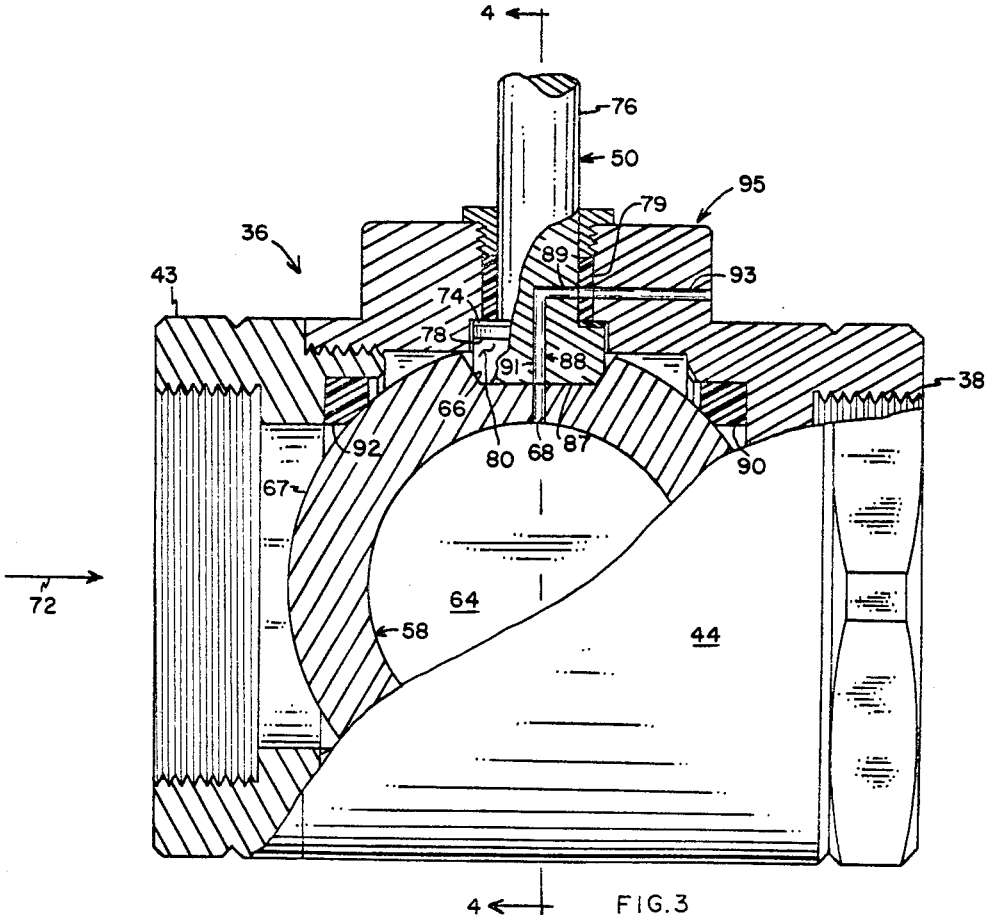
FIG. 3 is an elevational view, partially in section, of the valve assembly used in the flush hydrant of FIG. 1.

As shown in FIG. 3, ball valve assembly 36 includes body 44 having internally threaded end 38 integral therewith and a removable internal threaded end member 43 which is removable for insertion or removal of a closure member 58 into or from body 44. Member 58 is a generally round member having portions thereof removed. As more clearly seen in FIGS. 3, 4, and 5, member 58 is an annular member having substantially parallel surfaces 60 and 62. A large bore or opening 64 is provided in member 58 in normal relation to surfaces 60 and 62 and forms the main or primary water passageway of the valve. A slot 66 is machined in the outer surface 67 of member 58, and a small (approximately ⅛" diameter) hole 68 is drilled through the member and communicates between opening 64 and slot 66. A second hole or bore 70 (approximately ⅛" diameter) is drilled through member 58 and communicates into the opening 64 of the member. The axis of hole 70 is substantially parallel to surfaces 60 and 62 of member 58, and hole 70 is spaced approximately 90° around surface 67 from hole 68.

Figure 4:
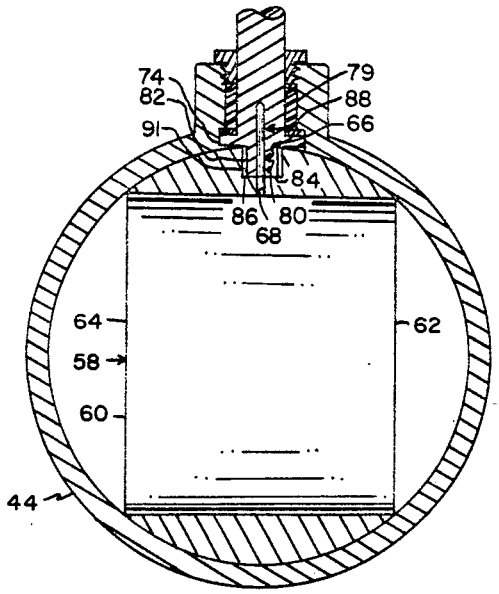
FIG. 4 is a sectional view taken along line 4—4 of FIG. 3.
Figure 5:
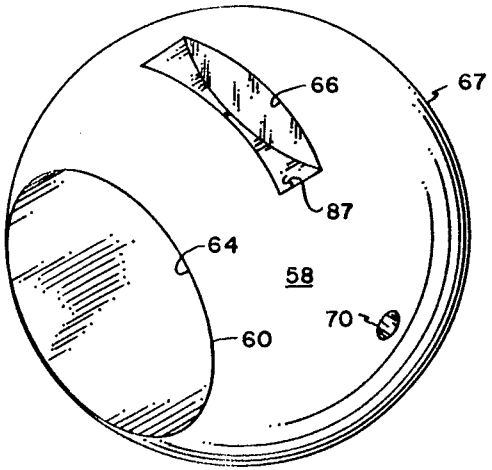
FIG. 5 is a pictorial view of the annular closure member of the valve assembly illustrated in FIG. 3.

To rotate member 58 for alignment of opening 64 thereof with the direction of water flow, designated by arrow 72 in FIGS. 1 and 3, and to provide for draining water from barrel 10 after the flush hydrant has been used, a valve stem 50 is mounted in slot 66 of member 58 and is secured to rod 46 (FIG. 1) for rotation thereby. As seen in FIGS. 3 and 4, stem 50 includes an upper rod portion 76, a flange portion 78, and a lower lever portion 80. Lever portion 80 (FIGS. 3 and 4) includes a pair of generally parallel sides 82 and 84 extending into slot 66 of member 58, and lever portion 80 further includes a bottom surface 86 which abuts against the bottom surface 87 of slot 66. Surface 86 may have a flat configuration as shown, or it may have any of many other configurations. Flange portion 78 seats against surface 67 of closure member 58 to retain the stem 50 in valve body 44. A Teflon TM valve stem packing sleeve 79 is mounted around the stem, and a gasket 74 may be also positioned around the rod portion 76 on flange portion 78. A bore 88 is provided in stem 50 and includes a lower portion 91 which extends through the stem from the bottom surface 86 to the upper rod portion 76 where it communicates with an upper portion 89 disposed in normal relation thereto and which extends out of rod portion 76. Portion 89 is disposed for communication with a bore 93 which is provided in an upper section 95 of valve body 44.

Figure 2:
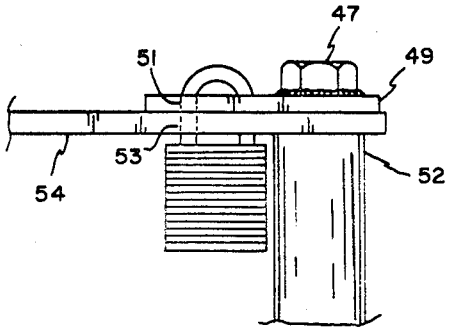
FIG. 2 is a partial elevational view of the flush hydrant of FIG. 1 and illustrating a locking mechanism to prevent unauthorized use of the device.

In operation, to flush the waterlines of the system in which the flush hydrant of the present invention is used, rod 46 is rotated one-quarter turn to align opening 64 of member 58 with the direction of water flow (arrow 72, FIGS. 1 and 3). Water then flows through valve body 44 and into barrel 12 and out of nozzle 24. The valve is then closed by rotating rod 46 in the reverse direction one-quarter turn so that member 58 is back in its original, or closed, position as seen in FIG. 2. The position of bar 49 relative to support member 54 (with holes 51 and 53 aligned) indicates that member 58 is in its closed position. Thus, it can be seen that bar 49 serves to indicate when the valve is closed, and it can also be seen that openings 51 and 53 of bar 49 and member 54, along with the padlock, serve as a means to secure the assembly in its closed position. When member 58 is in the closed position, its outer surface 67 rests against a Teflon TM gasket 90 mounted in body 44 and a second Teflon TM gasket 92 mounted in end member 43 to prevent passage of water around member 58. Also, in this (closed) position, bore 88 of stem 50 is in communication with the slot 66 and hole 68 of member 58 and with the barrel 12 through hole 70. In this position, bores or holes 70, 68, and 88 form a secondary water passageway, and the water remaining in barrel 12, after the valve has been closed, is drained from barrel 12, through hole 70 of member 58, into passage 64, and out of passage 64 through hole 68 and out of the valve body through bore 88 of stem 50.

Figure 7:
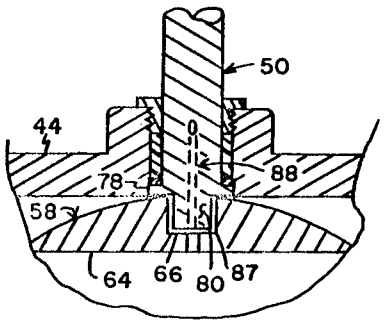
FIG. 7 is a sectional view taken along line 7—7 of FIG. 6.
Figure 6:
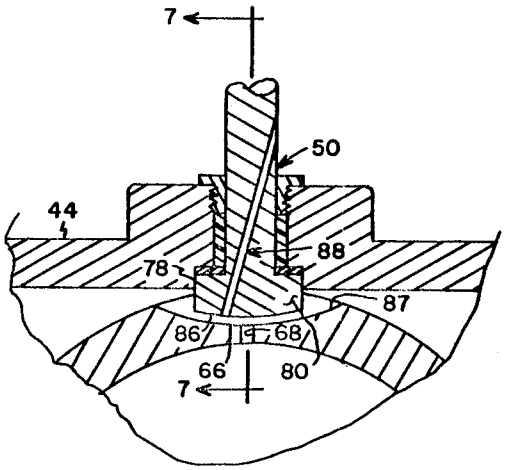
FIG. 6 is a partial elevational-sectional view similar to FIG. 3 and illustrating the lower lever portion of the valve stem as having an arcuate lower surface and a different angled path of the drain passageway through the stem.

If desired, stem 50 and member 58 may have other mating configurations. As shown in FIGS. 6 and 7, the lower lever portion 80 of stem 50 includes lower surface 86 which is arcuate and is spaced above surface 87 of slot 66 to permit water to fill the slot prior to entering the inclined bore 88.

Figure 8:
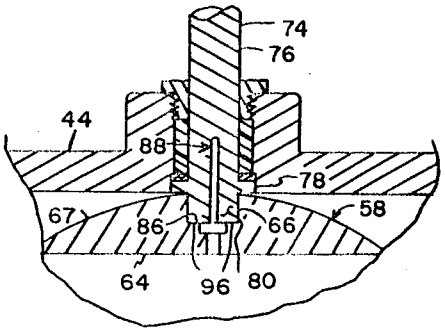
FIG. 8 is a partial sectional view similar to FIG. 4 illustrating an alternate configuration of the base of the stem shown in FIG. 3. In this embodiment, a pair of shoulders maintain the base of the stem in spaced relation with the bottom of a slot provided in the closure member.

As shown in FIG. 8 (which is a view similar to FIG. 7), stem 74 includes upper rod portion 76, flange portion 78, and lower lever portion 80. In this embodiment, lever portion 80 includes lower surface 86 which is flat and rests on a pair of spaced shoulders 96 provided in spaced relation in slot 66 of member 58. The bore 88 extends from lower surface 86 through the body of the stem and exits the stem at a 90° angle.

Still other configurations may be resorted to if desired. For example, the lower lever portion 80 of stem 74 may be conical or hemispherical, and slot 66 may have a matching configuration, it being only necessary that the lower lever portion 80 must be provided with projections extending therefrom to engage the surface of member 58 for rotating the member.

Figure 9:
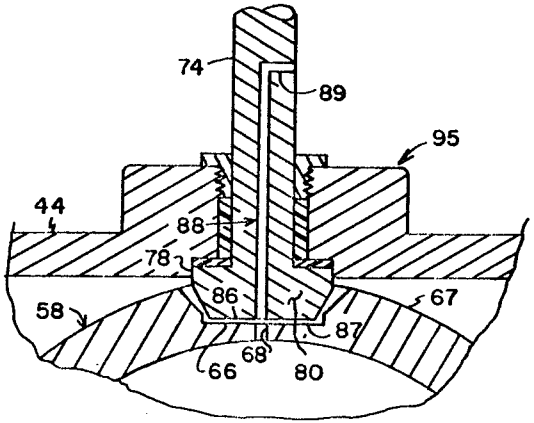
FIG. 9 is a partial sectional view of another embodiment similar to FIG. 3 with the drain passageway exiting through the stem directly to the atmosphere.

Additionally, if desired, the bore 93 is upper valve body portion 95 may be eliminated, and the bore 88 in the stem may be extended above valve body upper portion 95 (FIG. 9) so that upper bore portion 89 may communicate directly with the atmosphere instead of going through upper valve body portion 95.

What is claimed is:

1. A flush hydrant comprising:

a barrel having upper and lower ends;

a nozzle disposed on said upper end of said barrel;

a valve assembly having an upper portion, a first end connected to said lower end of said barrel in communication with the interior thereof, and a second end connected to a source of water, a valve stem having upper and lower ends, said valve stem rotatably mounted in said upper portion of said valve assembly and having a drainage passageway extending from said lower end of said valve stem to and out of said upper portion of said valve assembly in communication with the atmosphere, an annular closure rotatably mounted in said valve assembly and provided with a groove on an outer surface thereof to define a seat for said lower portion of said stem, said annular closure member having primary and secondary water passageways therethrough and being rotatably operable in said body between an open and closed position for passage of water through said primary passageway and into said barrel and for blocking passage of water through said primary passageway, respectively, said secondary passageway defined by first and second drain passages disposed in said annular member, said first drain passage disposed in communication with the interior of said barrel and with said primary passageway only when said closure member is in a closed position, said second drain passage disposed in communication with said groove on said surface of said annular member for continuous communication between said drainage passageway in said stem and said primary passageway;

operating means for rotating said closure member between said open and closed positions, said operating means including a rod secured to said valve stem and extending upwardly therefrom; and securing and indicating means disposed at a distal end of said rod and comprising a support member secured to said barrel and extending therefrom for support of said rod at said distal end, said support member provided with an opening therein, a bar secured to said distal end of said rod and extending therefrom, said bar having an opening therein disposed for registry with said opening of said support means when said annular member has been rotated to its closed position, and means for securing said bar and said support member together to secure said annular member in its closed position.

2. Apparatus as in claim 1 wherein said drainage passageway includes a passage extending in inclined relation in said stem, said passage having a lower portion exiting said stem adjacent said slot and an upper portion disposed in communication with the atmosphere.

3. Apparatus as in claim 1, wherein said drainage passageway includes a lower portion extending longitudinally in said valve stem and an upper portion disposed in normal relation to said lower portion.

* * * * *